US006996856B2

(12) United States Patent
Puchalski

(10) Patent No.: US 6,996,856 B2
(45) Date of Patent: Feb. 14, 2006

(54) PROTECTIVE HEAD COVERING HAVING IMPACT ABSORBING CRUMPLE ZONE

(76) Inventor: Ione G. Puchalski, P.O. Box 100, 7 Atkinson St., Ailsa Craig, Ontario (CA) N0M 1A0

( * ) Notice: Subject to any disclaimer, the term of this patent is extended or adjusted under 35 U.S.C. 154(b) by 0 days.

(21) Appl. No.: 11/103,533

(22) Filed: Apr. 12, 2005

(65) Prior Publication Data

US 2005/0257312 A1 Nov. 24, 2005

Related U.S. Application Data

(63) Continuation-in-part of application No. 10/867,667, filed on Jun. 16, 2004, which is a continuation-in-part of application No. 10/372,938, filed on Feb. 26, 2003, now Pat. No. 6,751,808.

(30) Foreign Application Priority Data

Sep. 9, 2002 (CA) ..... 2401929

(51) Int. Cl.
*A42B 3/00* (2006.01)

(52) U.S. Cl. ..... 2/411; 2/417; 2/425

(58) Field of Classification Search ..... 2/410, 2/411, 412, 417, 418, 419, 425
See application file for complete search history.

(56) References Cited

U.S. PATENT DOCUMENTS

| | | | | |
|---|---|---|---|---|
| 1,456,183 | A | 5/1923 | Knight | |
| 2,312,227 | A | 2/1943 | Yant | |
| 3,447,163 | A | 6/1969 | Bothwell | |
| 3,529,306 | A | 9/1970 | Thorne | |
| 3,579,637 | A | 5/1971 | Aileo | |
| 3,629,864 | A * | 12/1971 | Latina | 2/420 |

(Continued)

FOREIGN PATENT DOCUMENTS

EP 612483 A1 8/1994

*Primary Examiner*—Rodney M. Lindsey

(57) ABSTRACT

A helmet construction for protecting a user's head, and the brain within the cranium from impact forces, includes a shell contoured to the shape of the user's head, with cushioning along at least part of the shell interior and a chinstrap. The shell consists of three (or more) discrete panels that are physically and firmly coupled together providing rigid protection under most circumstances, but upon impact the panels move relative to one another, but not relative to the user's head, thereby permitting impact forces to be dissipated and/or redirected away from the cranium and brain within. Upon impact to the helmet, there are sequential stages of movement of the panels relative to each other, these movements initially being recoverable, but with sufficient vector forces the helmet undergoes structural changes in a pre-determined fashion, so that the recoverable and permanent movements cumulatively provide a protective 'crumple zone' or 'shear zone'. The first two stages of protection arise from the design of the fasteners that have the ability to invaginate and collapse within themselves, and their design having a 45 degree angle, which will allow movement of a region of connected panels to translate along the fastener shaft. Both of these movements will be recoverable and provide a 'functional crumple zone'. The final stage of protection arises from the braking function of the pins, as they are forced from one aperture through to the next, the direction and extent of which is determined by the impact force and direction. This final level of panel movement and protection is not recoverable and thus provides a 'structural crumple zone'. Finally the fastener size and thickness, together with the thickness of webbing and distance between apertures, functions to provide varying degrees of resistance to impact forces, thus making the helmet design suitable for activities with different levels of impact speed and risk potential.

20 Claims, 12 Drawing Sheets

U.S. PATENT DOCUMENTS

| | | | | | |
|---|---|---|---|---|---|
| 3,665,514 | A | | 5/1972 | Durand | |
| 4,223,409 | A | | 9/1980 | Lee | |
| 4,307,471 | A | | 12/1981 | Lovell | |
| 4,404,690 | A | | 9/1983 | Farquharson | |
| 4,472,472 | A | | 9/1984 | Schultz | |
| 4,477,929 | A | * | 10/1984 | Mattsson | 2/425 |
| 4,484,364 | A | | 11/1984 | Mitchell | |
| 4,539,715 | A | | 9/1985 | Clement | |
| 4,972,527 | A | | 11/1990 | Wallace | |
| 5,687,426 | A | | 11/1997 | Sperber | |
| 5,950,243 | A | | 9/1999 | Winters | |
| 6,108,824 | A | * | 8/2000 | Fournier et al. | 2/418 |
| 6,751,808 | B1 | * | 6/2004 | Puchalski | 2/411 |
| 2001/0032351 | A1 | * | 10/2001 | Nakayama et al. | 2/412 |

* cited by examiner

PROTECTIVE HEAD COVERING HAVING IMPACT ABSORBING CRUMPLE ZONE

RELATED APPLICATIONS

This application is a continuation-in-part of U.S. patent application Ser. No. 10/867,667, filed 16 Jun. 2004 and entitled "Protective Head Covering Having Impact Absorbing Crumple or Shear Zone", and which is filed as a continuation-in-part of U.S. patent application Ser. No. 10/372,938, filed 26 Feb. 2003, entitled "Sports Helmet Having Impact Absorbing Crumple or Shear Zone", and which issued to U.S. Pat. No. 6,751,808 on 22 Jun. 2004.

SCOPE OF THE INVENTION

The present invention relates to a protective head covering which, for example, may be used as a hard hat or sports helmet, and which is characterized by two or more parts or panel sections which are joined so that upon the application of a minimum impact force, the parts permit predetermined and controlled movement relative to each other in increments, via a series of mechanisms, to function overall as an impact absorbing 'crumple' or 'shear zone'.

Thus while providing the usual protection to the head from puncture or direct compressive force, this helmet will provide unique additional and much needed protection by absorbing and/or redirecting the impact forces across the skull, rather than transferring them through the cranium to the brain inside, as currently is the norm. If an egg is shaken hard, the yoke will break inside, as the transfer of forces cause the yoke to dash upon the insides of the shell, while the shell itself remains undamaged. Known as a 'contre' coup' injury, this is how 'shaken baby syndrome' injuries occur and is well documented as the mechanism of injury most responsible for the majority of brain trauma; not actual skull fractures. It is inherent in any fall or impact to the head and urgently needs to be addressed in helmet design. The present invention function to prevent this analogy happening to the delicate brain, which like the yoke is surrounded by fluid within a hard and unyielding shell, or cranium.

BACKGROUND OF THE INVENTION

The use of helmets to protect the head from injury has been done through the centuries, and for a variety of activities ranging from warfare to the more common uses today of sports and recreation. Typical helmet construction consists of a rigid or semi-rigid shell formed into a generally domed-shape, which covers the majority of the user's head and frequently incorporates a chinstrap to secure the shell in the preferred position on the head. Depending upon the shell construction, padding or cushioning may also be provided along the inside of the shell for increased comfort, better fit and to assist in the absorption of any impact forces.

Helmets from their first use to today, have essentially been an artificial skull over the human skull and thus only duplicate the same protection the natural skull is already providing, without adding any more safety dimensions. In fact, the extra 'skull' serves to increase the weight of the head relative to the neck muscles, which is well-researched cause of both soft tissue and bone injuries. More important for injuries, this additional weight increases the acceleration potential ((increased) mass×velocity) of the brain inside the cranium, after impact.

Conventional helmets are formed from molded semi-rigid polystyrene or Styrofoam™ bonded to a plastic outer skin, or the hard rigid shell is lined with soft padding. There is an important disadvantage and negative safety feature inherent with both of these common conventional helmet styles. In order to provide sufficient protection from impact forces, heretofore it has been the practice of the helmet manufacturers to form the polystyrene shell layer with a thickness of one inch or more, and if the padding is for comfort it is often of similar thickness. As a result, when worn, these sports helmets project outwardly a distance of two inches or more from the wearer's head, increasing the diameter of the natural skull and adding physical disproportion of head to shoulder/torso, for optimal muscular control.

Upon impact from anything other than a true perpendicular force vector, the skull/helmet combination acts as a fulcrum as the neck and body 'bends' around it. With increased diameter, the range and magnitude of 'bend' at the fulcrum is dramatically increased and ultimately, the quantity and quality of associated injuries. This is one of the most common ways for avulsion of bone, discs and muscles and it is the classical method for cervical nerve root stretch, rupture or avulsion. Termed a 'zinger' in its mild, temporary form, permanent total nerve loss results when the 'bending' injury is more severe. Larger diameter and/or added weight invariably increase rotational force potential and rotation, according to whiplash research, is the most destructive.

SUMMARY OF THE INVENTION

Accordingly, the present invention strives to overcome some of the disadvantages of prior art helmets by a) providing a protective head covering or helmet that is closer in weight and size to the user's anatomical head, thereby minimizing resultant disproportion between the head with helmet and the neck/torso and by b) redirecting or dissipating injurious forces away from the head and brain, by using multiple connected or interlocking component panels that will move relative to each other in predetermined directions and increments, effectively producing a 'crumple', 'slide' or 'shear', hereinafter are generally referred to as a "crumple zone".

A practical advantage with the present invention that also improves safety, is that the multiple portions or panels, enable better customizing to fit different head shapes such as oval, oblong and round, not just adapt to sizes. Parents will be able to customize the helmets as their children grow, thus avoiding the dangerous habit of buying oversized helmets so that the child will 'grow into it'. A frontal fall in a helmet that is too large, forces the helmet backwards and can force the back of the helmet into the neck at the base of the skull, at the anatomical area of the brain stem, with tragic results often worse than if a helmet had not been worn at all.

A further safety feature of the present invention exists in that because of the interconnected or interlocking panels, absorbing or re-directing force vectors along predetermined, incremental stages, any rotational vectors at the time of impact will be decreased or changed to linear vectors, thereby reducing the risk of the very damaging rotational injuries to the nerve roots and/or brain stem. The present helmet most preferably is designed to absorb kinetic and/or potential energy at the time of the fall/impact, and transfer it along more controlled, less damaging vectors away from the head and brain.

A practical consideration is that the helmet design should be lightweight, comfortable and versatile enough to accommodate not only most recreational and sporting activities including bicycling, snowboarding, skateboarding, roller blading, horseback riding and with minimal modifications to protect the face, more aggressive activities such as hockey and football, but also will provide head protection as a motorcycle helmet, as an army helmet in military applications, or as a hard hat in construction and mining applications. Thoughts have been given to aesthetics, since a helmet cannot protect if it is not worn and thus, especially for the high risk, energetic youths, this design allows for simple dressing with caps to provide 'visual appeal'.

There has been a desperate call from the professional community treating head injuries, for a radically different helmet design, away from the 'skull over the skull' concept, to one that incorporates current knowledge of how head, neck and especially 'contre' coup' injuries occur. The design of this helmet focuses first on accepted injury mechanisms and then simulates some of the effective structural features used in automobiles to reduce passenger injuries and some used in building structures to reduce earthquake damage. If the impact is severe enough, the final stages of the helmet 'crumple zone' will allow structural alterations, similar to vehicle crumple zones, thereby minimizing transfer of injurious forces to what it is protecting.

One possible basic helmet basic design includes an 'I' shaped central convex shaped component extending across the vertex/top of the skull, with the shorter extensions covering the forehead and base of the skull. In addition to this, there are two lateral convex components covering the sides of the skull, which interlock and join the centrepiece to complete the helmet. The three panels may be physically joined together in several ways concurrently, including a slot/tab arrangement or through the use of mechanical fasteners such as permanent or removable screws, pins, clips and/or rivets and the like. The slots/tab configurations and the fasteners allow incremental, predetermined movement, between the component parts upon impact.

Where pins or rivets are used to connect the two lateral helmet panels to the central one and the many holes for them, the pins contribute to the first two levels of protection. As a result of their structure, orientation and when impact forces are very high, the pin strength and ability to break though from the hole they were in, to the adjacent one(s) acts to absorb impact forces. All of these levels of protections function within the helmet structure and design, leaving the head and skull inside as little involved as possible.

In a preferred construction, convex, central panel preferably has two layers of material, separated by a small space that is greatest at the vertex and decreases towards the edges where the two pieces ultimately merge. While the overall shape may be similar to a generally "I" shape, optionally, there may be perpendicular finger like projections along it's length. The projections may furthermore be the means whereby the central panel is connected to the two lateral panels. The two lateral components, also generally convex, may similarly consist of two layers that are separated by a small space, but in these panels the space will be negligible at the inferior margins, widening increasingly towards the superior aspect, where the space would remain open just enough to admit the finger like projections from the central panel, thereby completing the full head helmet. The projections along the length of the central panel will invaginate between the two layers of the lateral side panels, being firmly fastened by means of rivets or pins.

Pins/rivets are attached at all of the central panel projections, where the double thickness has merged until there is no longer air space between. These central panel projections will with many location choices of complementary holes in the lateral panels, connect and complete the full head helmet. This provides exceptional customization, not only to the size of the wearer's head but also to the shape, be it round, oblong, oval, broader at the front or otherwise. The holes not used to fix the three panels together, along with the spaces between the fingers like projections will additionally function for ventilation and cooling; an important feature since almost three-quarters of body heat is given off at the head.

The pins/rivets used for the helmet optionally may have two pieces that screw together, thereby joining the lateral and central helmet panels as the two pieces of the rivet are fastened together, possibly allowing some internal residual motion between the two pieces of rivet. The pins/rivets might be attached at an angle such as forty-five degrees, and although secure once fastened, these pins/rivets may be disassembled, allowing readjustment of the helmet size and shape. The protective mechanisms would engage in stages and summate to form the 'crumple zone' when necessary for optimal protection of the delicate head and brain within.

With impact at a side panel over the ear for example, the pins/rivets first hold firm; then allow some internal movement at the site joining the lateral and central panel projections; then if the pins/rivets are angled and the force vectors are strong enough, the impacted panel would be 'shifted' somewhat along the specific direction and linear line of the angled pin/rivet; and finally when the impact is very severe, the pin/rivet would break through to the adjacent hole(s), thereby braking or reducing the overall magnitude of the impact force. It is to be appreciated that the fastener/projection contact and subsequent projection deformation, allow the panels to move relative to each other, and more preferably so that the fastener assumes an orientation located at least partially in a next adjacent opening. It is to be appreciated that the relative movement of the panels and the deformation of the webs act to gradually dissipate the energy of the impact force, without translating the energy to the wearer's skull and more important the brain.

In an alternate possible embodiment, the helmet design includes a central convex shaped shell which is provided with a single, or more preferably multiple layered outer shell panel or portion, and an inner shell panel or portion. The shell is sized to cover at least part of one or more of the front, top and rear portions of the user's head, with the inner shell portion having a curved shape which is generally complimentary to the outer portion. A fastener is provided to secure the inner shell portion to the outer shell portion. Preferably, the fastener is operable to couple the shell portions to each other under an adjustable compressive tension, and which for example, most preferably may be adjustably selected to allow limited sliding movement of the inner and outer shell portions relative to each other, upon the application of a predetermined minimum force thereto.

In a more preferred construction, at least one overlapping area, one or both of the inner or outer shell portions are provided with a plurality of recesses therein. The recesses may be in the form of depressions, indentations, or in a simplified construction, through-apertures which extend through the shell portions. A locating member such as a boss, a stud, a spherical Nylon™ or other plastic bearing, or other suitable protuberance is provided, so as to locate at least partially within a selected recess when the inner and outer shell portions are coupled in an initial position to each other. The locating member, bearing or the like advantageously may be used to assist in absorbing impact forces. In particular, on the application of a predetermined minimum force to the helmet, the outer shell portion will tend to move relative to the inner shell portion. As relative movement occurs, the locating member is urged from its position in partial engagement within a first selected recess, sliding outwardly therefrom and into a next adjacent recess. It is to be appreciated that the relocation and reengagement of the locating member within next adjacent recess as the inner and outer shell portions slide relative to each other bearing or the like acts dissipate impact forces, preventing therein transmittal to the helmet user.

The final sizing of helmet and extent to which it covers the user's forehead, occiput or temporal/lateral area of the skull, will depend somewhat to the degree of head protection sought for that particular activity or sport. However the construction will ensure a standard of skull coverage, which will offer the customary head protection, such as resilient cushioning straps and the like, in addition to the much needed improvements with the moving panels Where, for example, this design is to be used as a bicycle, roller blading or horseback-riding helmet, typically the sides of the shell portion would not extend below the user's ear or below the base of the skull at the back. Where the helmet is modified for use in other more aggressive and/or higher speed sports, or to suit military needs, it is to be appreciated that the helmet configuration would be adapted to provide increased coverage to the user's head, typically by extending in the rear beyond the base of the user's skull and laterally at least to the user's cheek bones on each side.

The 'crumple zone' characteristic of this helmet design is accomplished through overlapping levels of protection, where each aspect addresses a specific range of impact magnitude which when exceeded, transfers the forces to the next level of protection.

By means the of interlocking or interconnecting and force re-directing panels, the present helmet design remains closer to the natural head size and weight thereby; a) avoiding the increased injury risks noted above and b) providing equitable skull protection for simple direct impact and most important of all c) uniquely minimizing the most common and destructive 'contré coup' injuries.

Accordingly, in one aspect, the present invention resides in a helmet for protecting a user's head from impact forces, said helmet comprising, a generally dome shaped shell, said shell being formed from a rigid or semi-rigid material and sized and contoured to cover a surface of said user's head to be protected, said shell including a first portion and a second portion, a plurality of locating recess formed in a region of said first portion, the recesses being delineated from a next immediately adjacent recess by a web member, said second portion including at least one locating boss positioned to align with a selected one of said recesses when part of said second portion is located substantially in overlying juxtaposition with said first portion, and a fastener coupling the first portion in overlying juxtaposition with the second portion, under a tension selected so that the application of a predetermined minimum force to at least one of said first portion and said second portion enables relative movement of the at least one boss from the selected one of said recesses into a next adjacent recess and the limited movement of said first portion relative to said second portion.

In another aspect, the present invention resides in a protective head covering for protecting a user's head comprising a generally rigid shell, the shell including a central portion contoured so as to substantially cover the upper front and rear portions of said user's head, and having an outer portion and an inner portion, a first array of recesses in a first one of said inner portion and said outer portion, at least one coupling member for engagement with a selected one of said recesses of said first array, said coupling member engaging the second other one of said inner portion, a fastener coupling the inner portion to the outer portion under a tension selected whereby the application of a predetermined minimum force to the central portion results in the limited movement of the inner portion relative to said outer portion, and the movement of the coupling member in the direction of impact forces from the selected recess into at least one next adjacent.

In a further aspect, the present invention resides in a helmet for protecting a user's head from frontal and side impacts, said helmet comprising, a generally dome shaped shell, said shell sized and contoured to substantially cover said user's head, and including an outer, central member elongated longitudinally so as to extend across front and rear portions of said user's head and an inner central member sized for overlying a portion of said user's head and provided in overlying juxtaposition with a part of said central member, at least one of the outer central member and the inner central member including a first array of a plurality recesses formed therein, the other one of said outer central member and the inner central member including a locating boss positioned so as to align with a selected one of said plurality of recesses in said first array, and at least one fastener connecting the inner central member to the outer central member under a tension selected, whereby the application of said predetermined minimum force to at least one of the outer central member and the inner central member enables both relative sliding movement of the boss into a next adjacent recess and the limited relative movement of the outer and inner central members.

BRIEF DESCRIPTION OF THE DRAWINGS

Reference will now be had to the following detailed description taken together with the accompanying drawings in which.

DETAILED DESCRIPTION OF THE PREFERRED EMBODIMENTS

Figure 1:
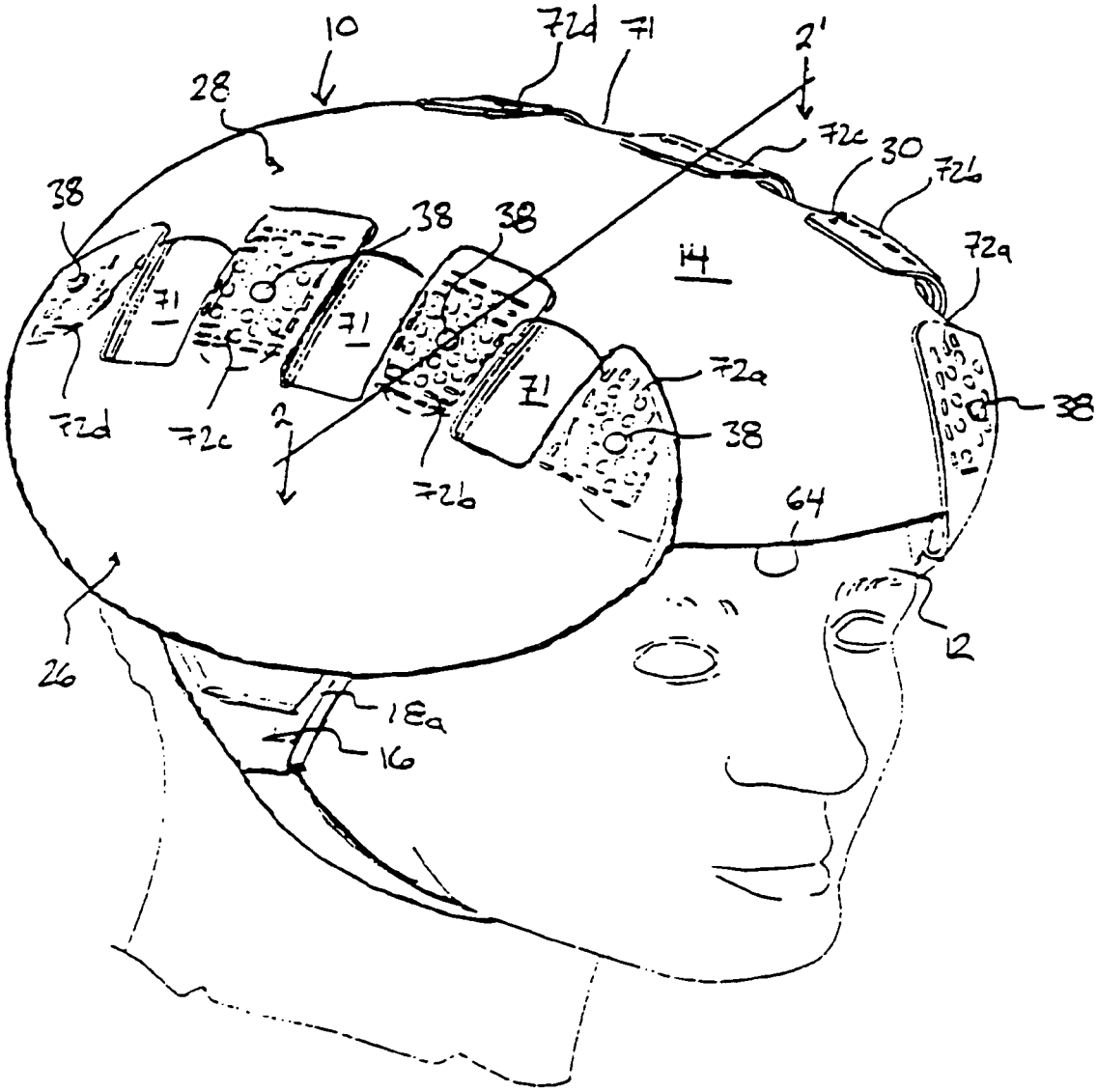
FIG. 1 shows a perspective view of a bicycle helmet construction in accordance with a first preferred embodiment of the invention, as used in position on a user's head.
Figure 2:
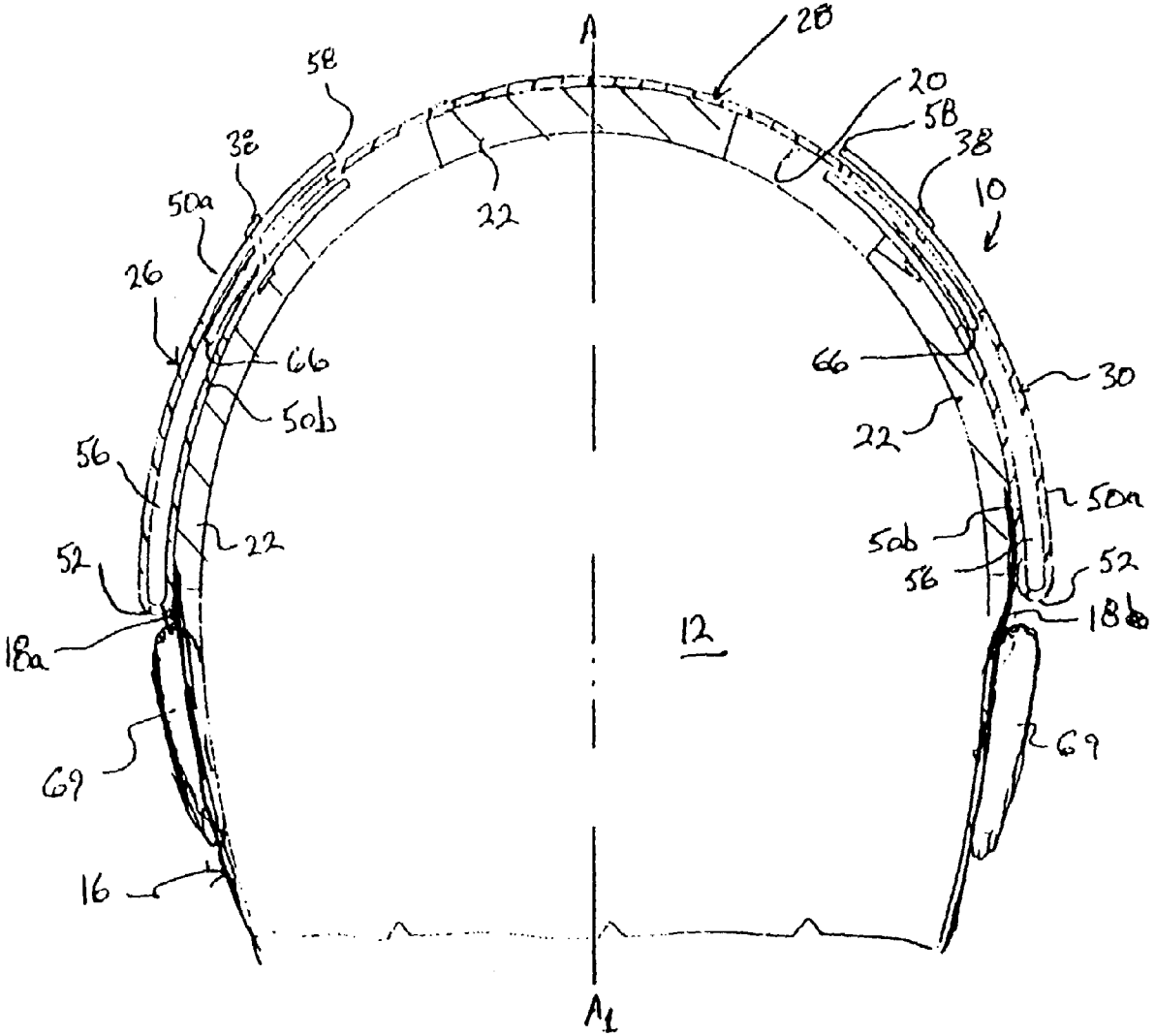
FIG. 2 illustrates a cross-sectional view of the helmet construction shown in FIG. 1 taken along lines 2—2.

Reference may first be had to FIG. 1 which illustrates a bicycle helmet construction 10 for use in protecting a user's head 12 from impact forces, which for example would occur if the wearer was struck by a car or otherwise was thrown from a bicycle (not shown). The helmet construction 10 includes a generally domed shaped shell 14 which is secured in place on top of the user's head 12 by a releasable chin strap 16. The chin strap 16 is of a conventional two-piece design and is secured at each of its ends 18*a*,18*b* (FIG. 2) to a respective longitudinal side portion of the shell 14. As shown best in FIG. 2, the shell 14 has a size and contour selected so as to substantially cover the top of the user's head 12 and extends symmetrically in the front-to-back direction about a vertical central axis $A–A_1$ (FIG. 2). The inner surface 20 of the shell 14 which is immediately adjacent to the user's head 12 is lined with strips of resiliently compressible foam cushioning 22. The cushioning 22 assists in maintaining the shell 14 comfortably in the correct position on top of the user's head 12 and furthermore, advantageously acts to assist in the absorption of impact forces.

The shell 14 is composed of three separate or discrete panels 26,28,30 which, as will be described, are interconnected to provide the shell 14 with its contoured dome shape. Each of the panels 26,28,30 are made of rigid or semi-rigid plastic which is generally curved to a corresponding portion of the user's head, and have a cross-sectional thickness selected to provide the desired degree of impact protection. In the case of a bicycle helmet, the plastic used to form the panels 26,28,30 would have a cross-sectional thickness of about 1 to 2 mm, however, thicker or thinner panel constructions could be used. As shown in FIG. 2, the panel 26 which covers the right side of the user's head 12 is formed in the mirror construction to the panel 30 used to cover the left side. The panels 26,28,30 are interconnected by physically coupling the right side panel 26 and the left side panel 30 to the central panel 28 by a series of two-piece rivets 38. As shown best in FIG. 3, the rivets 38 are configured to be assembled in a releasable screw-fit arrangement and include a male portion 40 and a female portion 42. Both portions 40,42 of the rivet include a respective shaft 44 and an enlarged diameter head 46. The shaft 44 of the male portion 40 is characterized by an externally threaded tip. The shaft 44 of female portion 42 includes an internally threaded socket sized to receive the threaded tip of the male potion 40 in a screw fit.

Figure 3:
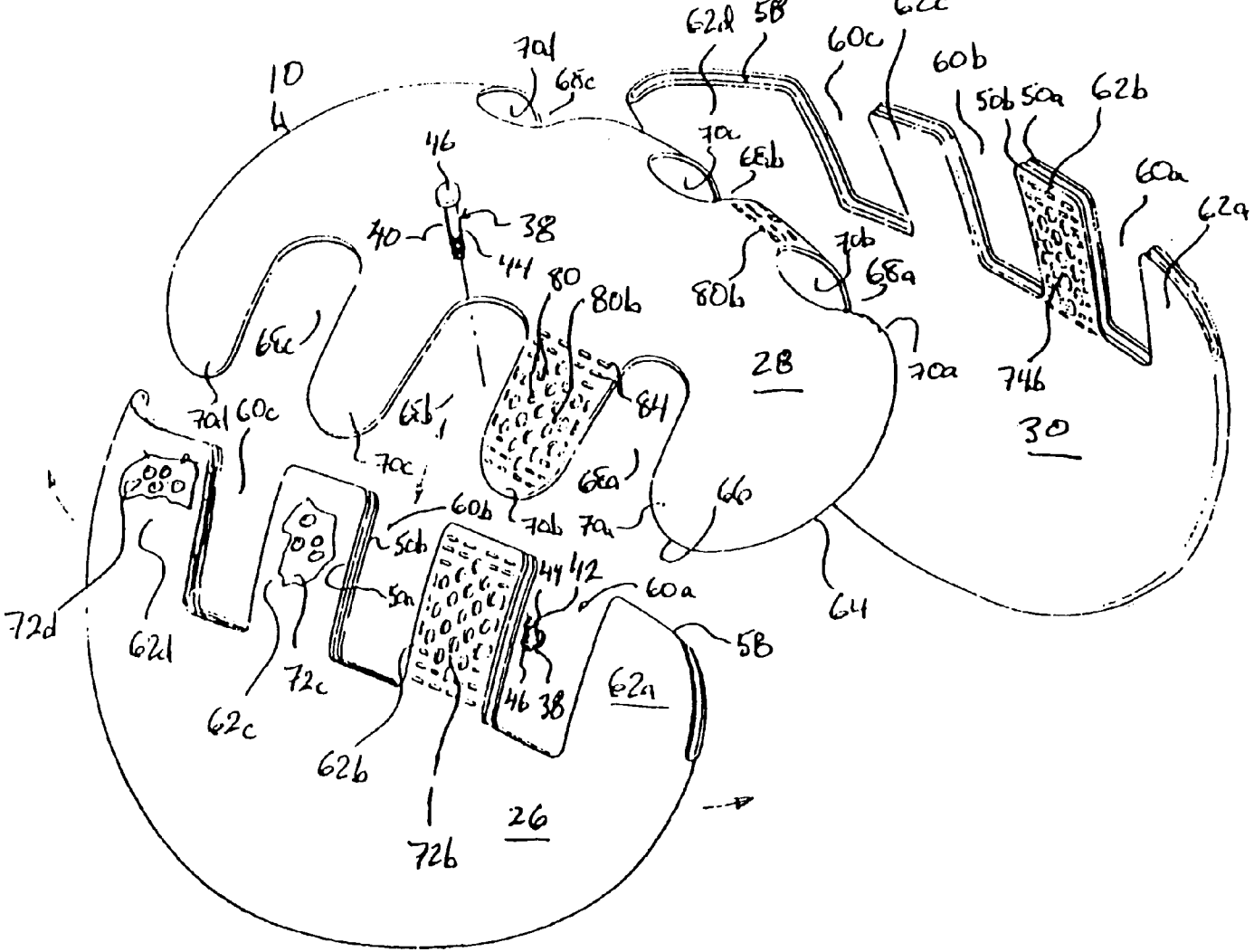
FIG. 3 illustrates a partial exploded perspective view of the helmet construction of FIG. 1 showing the manner of interconnecting the panels.

FIG. 2 shows best the right side and left side panels 26,30 as being formed with a double sidewall 50*a*,50*b* construction. The sidewalls 50*a*,50*b* of each panel 26,30 are spaced apart in a generally parallel relationship to each other, and merge at an outermost edge bight 52. The sidewalls 50*a*,50*b* and bight 52 defining an interior cavity 56 which is open along an innermost edge 58 spaced closest towards the axis $A–A_1$. FIG. 3 shows best the innermost edge 58 of each side panel 26,30 as including three longitudinally spaced cut-outs or recesses 60*a*,60*b*,60*c*. The recesses 60,60*b*,60*c* extend inwardly through both sidewalls 50*a*,50*b* a distance towards the bight 52 and delineate four remaining tab portions 62*a*,62*b*,62*c*,62*d* which, as will be described, in assembly overlap part of the central panel 28.

The central panel 28 extends in the longitudinal direction from its front edge 64 at about the brow of the user's head 12 rearwardly to rear edge (not shown) at about the base of wearer's skull. In the lateral direction, the panel 28 is symmetrical about the axis $A–A_1$ and most preferably spans between generally parallel longitudinal edge portions 66 spaced generally above the user's ears 69 (FIG. 2). Three recesses 68*a*,68*b*,68*c* (FIG. 3) extend inwardly towards the axis $A–A_1$ from each respective side edge portion 66 of the panel. As shown in FIG. 1, the recesses 68*a*,68*b* and 68*c* are formed with a complementary size and spacing selected so as to align with the recesses 60*a*,60*b*,60*c* of a respective side panel 26,30 when the panel sections 26,28,30 are interconnected, so as to form ventilation holes (71) through the shell 14. If desired, however, additional ventilation holes could also be provided through one or more portions of the central panel 28 and/or either both side panels 26,28. The recesses 68*a*,68*b*,68*c* also function to delineate four outwardly projecting tab portions 70*a*,70*b*,70*c*,70*d* along each side portion 66.

Figure 4A:
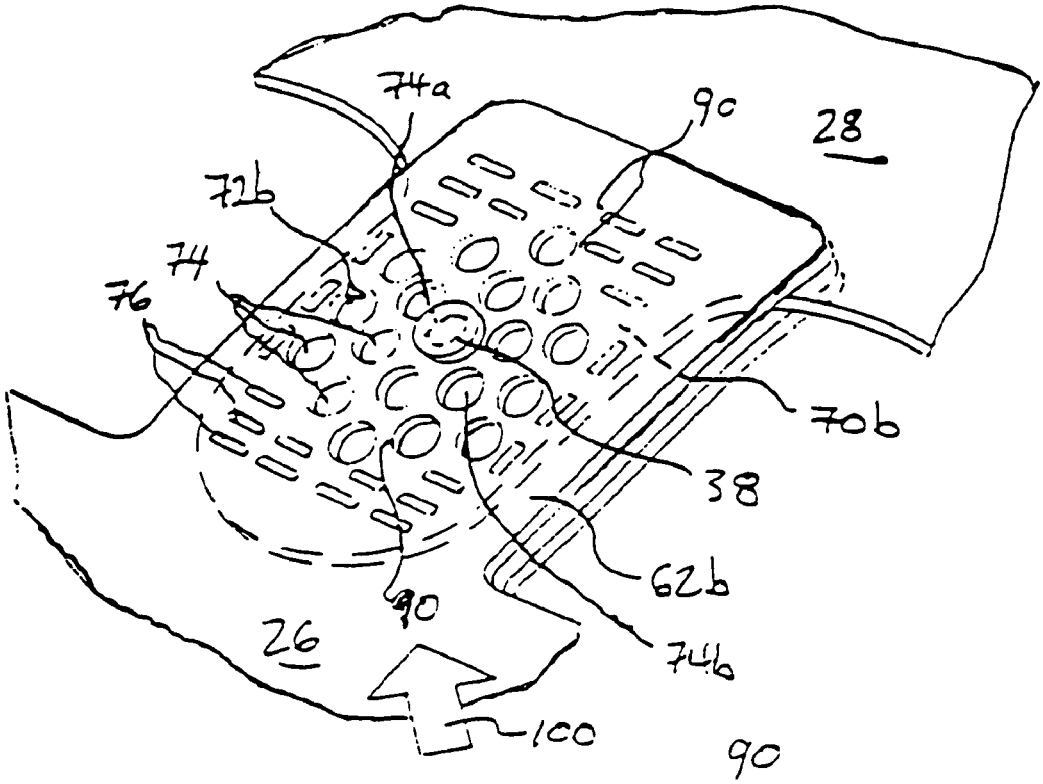
FIGS. 4*a* and 4*b* illustrate partial perspective views showing the limited relative movement of the shell panel portions in the absorption of impact forces.
Figure 4B:
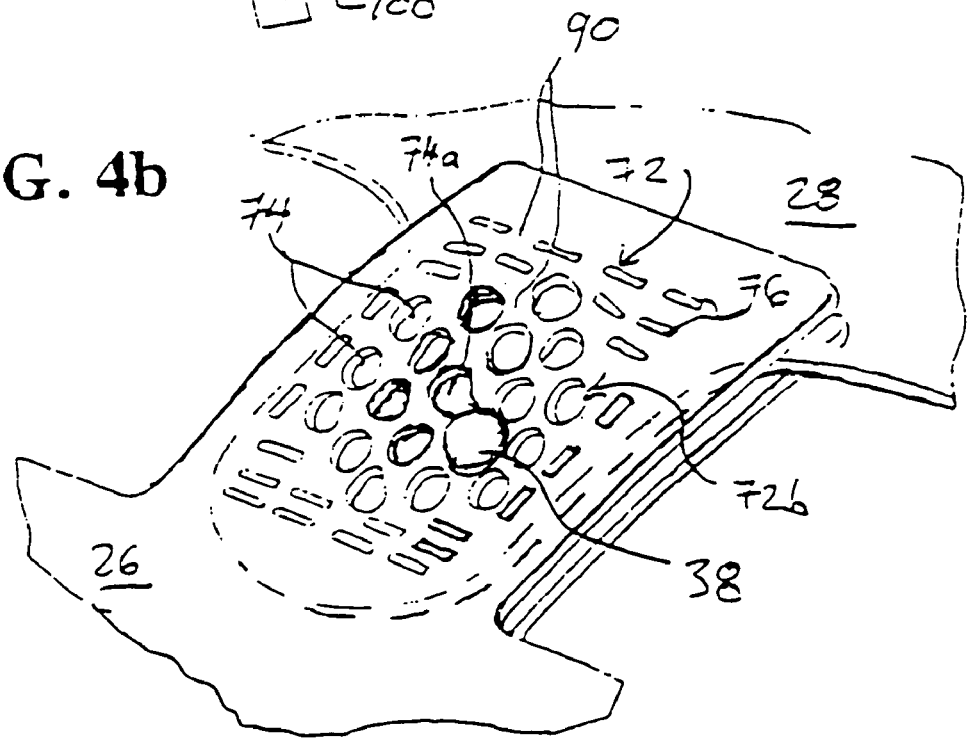

As seen best in FIG. 1, four arrays of aligned apertures 72*a*,72*b*,72*c*,72*d* are formed through both sidewalls 50*a*,50*b* of each tab portion 62*a*,62*b*,62*c*,62*d*, respectively, in each panel 26,30. FIGS. 4*a* and 4*b* show best the arrays 72*a–d* as each consisting of a number of adjacent larger central openings 74. The central openings 74 each having a radial diameter which is selected greater than the diameter of the shaft 44 portions of each rivet 38, but less than the diameter of the rivet heads 46. A series of smaller peripheral openings 76 are provided extending radially about the central openings 74. The smaller openings 76 have a diameter which is selected smaller than the diameter shaft portions 44 of the rivets 38. Similarly, an array of apertures 80*a*,80*b*,80*c*,80*d* is formed in each respective tab portion 70*a*,70*b*,70*c*,70*d* along each longitudinal side 66 of the central panel 28. For clarity, FIG. 3 shows only the aperture arrays 72*b* formed in panel 26 together with an aperture array 80*b* formed in the adjacent portion of the central panel 26. The aperture arrays 80*a–d* of the central panel 28 are shown having a series of larger diameter central openings 82 (FIG. 3) surrounded by smaller peripheral openings 84 which correspond in size and positioning to the pattern of openings 74,76 in the array 72*b* of the side panel 26. It is to be appreciated that although FIG. 3 illustrates the aperture array 80*b* and the adjacent aperture array 52*b* of the panel 26 for clarity, it is to be appreciated as is shown in FIG. 1, each longitudinal side of the central panel 28 is provided with a corresponding number of aperture arrays 80*a*,80*b*,80*c*,80*d* corresponding to those of the panels 26,30.

Figure 5A:
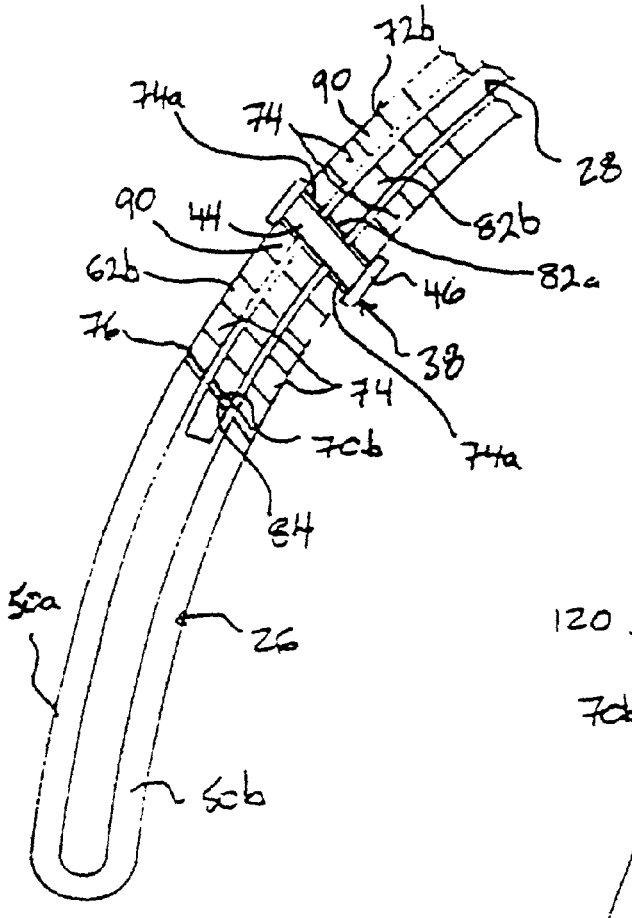
FIGS. 5*a* and 5*b* illustrate cross-sectional views showing the limited relative movement of the panel portions in absorbing a side impact force.
Figure 5B:
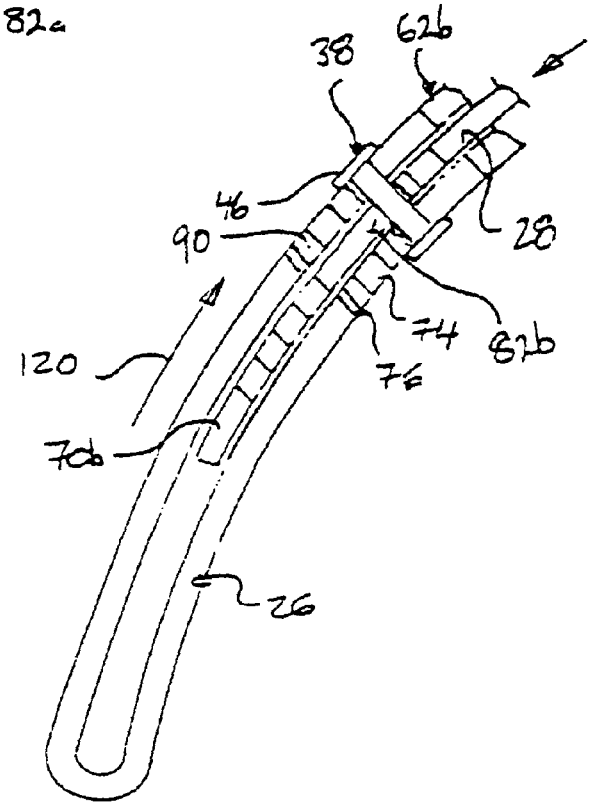

FIGS. 5*a* and 5*b* show best the central openings 74 and 76 of the arrays 72*a*,72*b* as extending through both of the sidewalls 50*a*,50*b* in an aligned orientation. The openings 74,76 are defined by and separated from a next immediately adjacent opening 74 or 76, by a web 90 of plastic which is used to form the shell 14. The webs 90 have a lateral extent having regard to the thickness of the sidewalls 50*a*,50*b* selected to permit the deformation of the web 90 upon a predetermined minimum force (shown by arrow 100 in FIGS. 4*a* and 5*b*). As with the openings 74,76, the openings 82,84 of the aperture arrays 80*a–d* are also delineated from a next immediate opening 82,84 by a like web 90 of plastic used in the formation of the central panel 28. The webs 90 of the central panel 28 have a lateral extent and thickness selected so as to preferably permit their deformation upon the application of the predetermined minimum force 100 thereto.

As shown best in FIG. 3, the use of removable rivets 38 advantageously permit adjustment in the relative positioning of the shell panels 26, 28 and 30. This adjustable positioning enables the helmet assembly 10 to be fitted to differing sized heads 12. In particular, in assembly of the shell 14, the outer tab portions 70*a–d* of each side 66 of the central panel 28 are fitted between the sidewalls 50*a*,50*b* and into the interior cavity 56 of each side panel 26,30, respectively. The panels 26 and 28, and 28 and 30 are positioned so that the aperture arrays 80*a*,80*b*,80*c*,80*d* in each peripheral edge portion 66 at least partially align with respective aperture arrays 72*a*,72*b*, 72*d*,72*d* formed through the panels 26,30. Once so positioned, the panels 26,28 are moved relative to the central panel 28 either towards or away from the axis $A–A_1$ to achieve the desired fit for the helmet assembly 10 with at least one selected larger opening 74*a*,82*a* in each array 72*a*,80*a*, 72*b*,80*b*, 72*c*,80*c* and 72*d*,80*d* aligned. Once the desired relative positioning of the shell panels 26,28,30 has been achieved, the shaft 44 of the male portion 40 of the rivets 38 are inserted through the selected aligned openings 74*a*,82*b* (FIG. 5*a*) and the female portion 42 of the rivet 38 is thereafter coupled thereto by the threaded engagement of the socket with the threaded tip of portion 40. Although not essential, most preferably, the enlarged heads 46 of the male and female portions 40,42 of each rivet 38 are offset relative to each other. As shown best in FIG. 3, the rivet head offset is selected so that the shaft 44 of the assembled rivet 38 extends generally in a direction inclined in the direction of a likely impact force (shown by arrow 100).

The helmet assembly 10 advantageously acts to absorb and dissipate an impact force 100 without the requirement of thick layers of padding or cushioning. It is to be appreciated, that the shell 14 may thus be provided with a comparatively smaller profile than a conventional bike helmet and, for example, could be formed so as to extend less than two inches, and more preferably less than one inch beyond the radial extent of each side of the wearer's head 12.

Figure 5B:
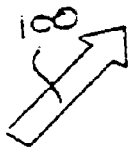

In particular, as shown best in FIGS. 4 and 5, upon the application of a predetermined minimum impact force (arrow 100) which, for example, could be selected as the force which occurs when a user falls and strikes his head 12 against an object, the impact force 100 acts on the panel 26 (or alternately the panel 28 or panel 30, depending upon the point of impact). The impact of a force 100 exceeding the predetermined minimum force results in the movement of the panel 26 in the direction of arrow 120 (FIG. 5*b*) relative to the panel 28. In particular, the force 100 urges the panel 26 in movement relative to the remainder of the helmet assembly 10. As the panel 26 moves, the shafts 44 of the assembled rivets 38 are brought into bearing contact with the webs 90 which define the selected aligned openings 74*a*, 82*a*. As the side panel 26 moves, the rivets 38 are forced against the webs 90, resulting in their deformation, as for example is shown in FIGS. 4*b* and 5*b* and the resulting relocation of each rivet 38 into a position aligned in a next adjacent opening 74*b*,82*b* as shown in FIG. 4*b*. It is to be appreciated that if a sufficient impact force 100 occurs, the portions 26,28 continue in relative movement, with the rivets 38 continuing to bear against and deform the webs 90 of adjacent openings 74,82. As such, the webs 90, in response to the impact force 100, sequentially deform in the direction of the applied impact force 100 thereby absorbing and dissipating the impact force 100 and permitting limited relative movement of the panel 26 relative to the panel 28.

It is to be appreciated that the presence of smaller peripheral openings 76,84 are provided as an added safety feature. In particular, the use of smaller diameter openings 76,84 which have a diameter smaller than the shaft 44 of the assembled rivets 38 advantageously prevent the panels 26 and 28, and 28 and 30 from being connected whereby the application of an impact force 100 would not be absorbed by a deformable web 90.

Although FIG. 3 illustrates the aperture arrays 72,80 as including a series of larger central openings 74,82 surrounded by a number of smaller diameter openings 76,84, respectively, the invention is not so limited. If desired, the smaller diameter openings 76,84 may be provided only about a portion of the openings 74,82, as for example, aligned in the direction of likely impact forces, or for that matter they may be omitted in their entirety.

It is to be appreciated that the construction of the helmet assembly 10 permits the shell 14 to be formed with comparatively thinner profile, while still dissipating impact forces 100. As such, the helmet assembly 10 may be closer fitted to the actual dimension of a user's head, and minimizes the likelihood that the wearer could suffer neck or soft tissue injuries which are associated with conventional helmet constructions.

Figure 6:
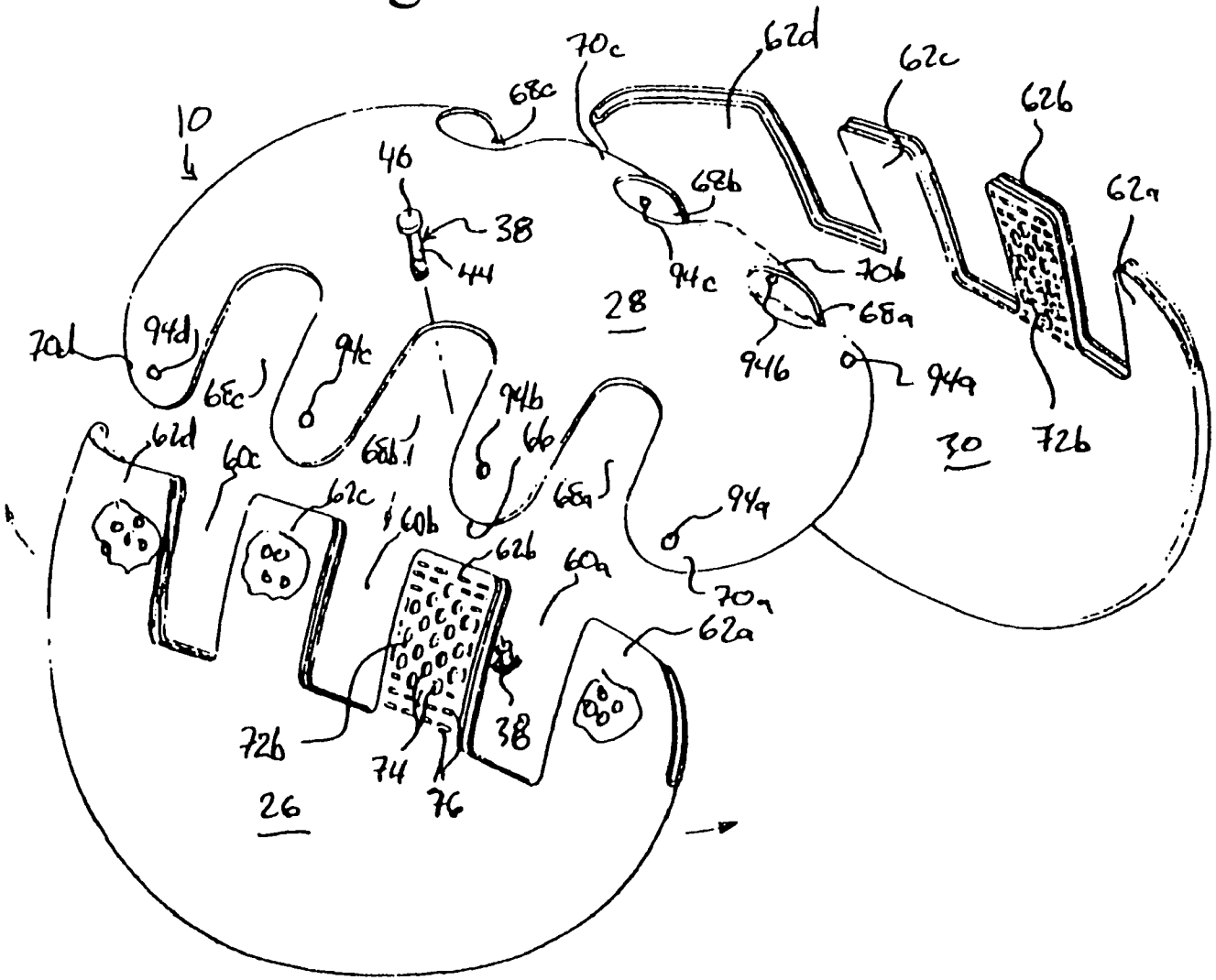
FIG. 6 illustrates a partial exploded perspective view of a helmet construction in accordance with a further embodiment of the invention.

Although FIGS. 1 to 5 illustrate the central panel 28 of the shell 14 as having a series of aperture arrays 80*a–d* formed along each edge portion 66 thereof, the invention is not so limited. FIG. 6 illustrates a partial perspective exploded view of a helmet assembly 10 in accordance with a further embodiment of the invention wherein like reference numerals illustrate like components. In FIG. 6, the longitudinal sides 66 of central panel 28 are provided with a series of single apertures 94*a*,94*b*,94*c*,94*d* in each tab portion 70*a*, 70*b*,70*c*,70*d*, respectively. The apertures 94*a–d* have a size corresponding to the larger central openings 74 of the arrays 72*a–d* so as to permit insertion of a rivet 38 shaft 44 through the aperture 94 when aligned with a corresponding central opening 74 to couple the panels 26,28 and 28,30.

It is to be appreciated that with the construction of helmet assembly 10 shown in FIG. 6, the application of an impact force upon one of the panels 26,28 or 28,30 results in their relative sliding movement and the deformation of only the webs 90 which define the openings 74,76.

Although FIGS. 1 to 6 describe the right and left side panels 26,30 of the helmet assembly 10 as having a double wall 50*a*,50*b* construction, the invention is not so limited. It is to be appreciated that if desired, the central panel 28 could alternately be provided with a double wall construction, or for that matter only panels 26,28,30 having a single wall construction could be used.

Figure 7:
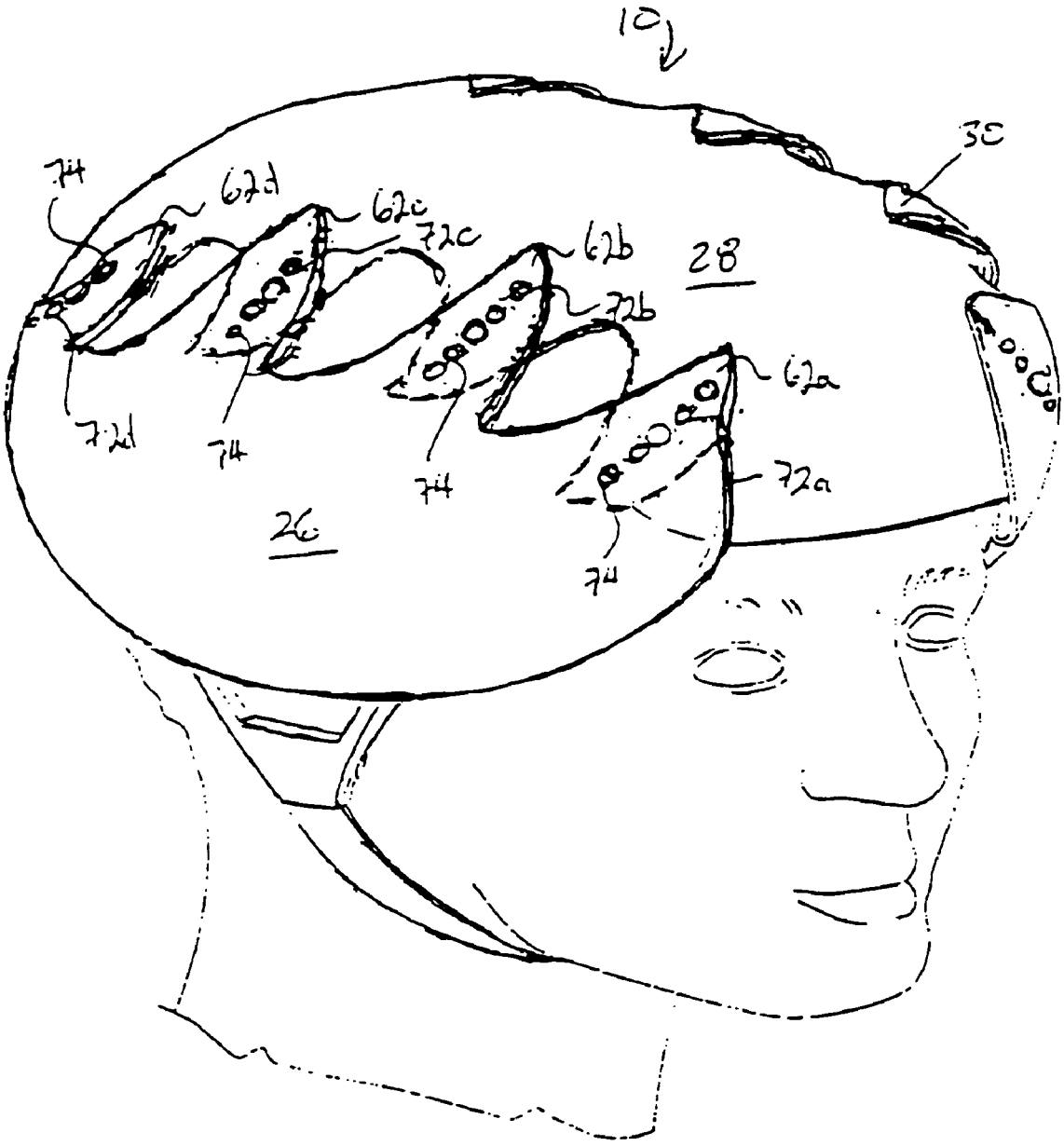
FIG. 7 illustrates a perspective view of a bicycle helmet construction in accordance with another embodiment of the invention.

Although FIGS. 1 to 6 illustrate the helmet construction 10 as including panels 26 and 30 which include arrays 72*a–d* of a central opening 74 surrounded by smaller peripheral opening 76, the invention is not so limited. Reference may be had to FIG. 7 which shows a helmet construction 10 in which like reference numerals are used to identify like components.

In FIG. 7, the panels 26,30 are formed with a series of projections 62*a–d* which have a shark-tooth profile. A line of openings 74 extends along each projection to form each respective array 72*a*,72*b*,72*c*,72*d*. The openings 74 are oriented in a longitudinal line which is general parallel to the direction of typical impact forces and which is approximately inclined at an angle of 45° towards the central longitudinal axis $A–A_1$ (see FIG. 2) of the helmet.

Figure 8:
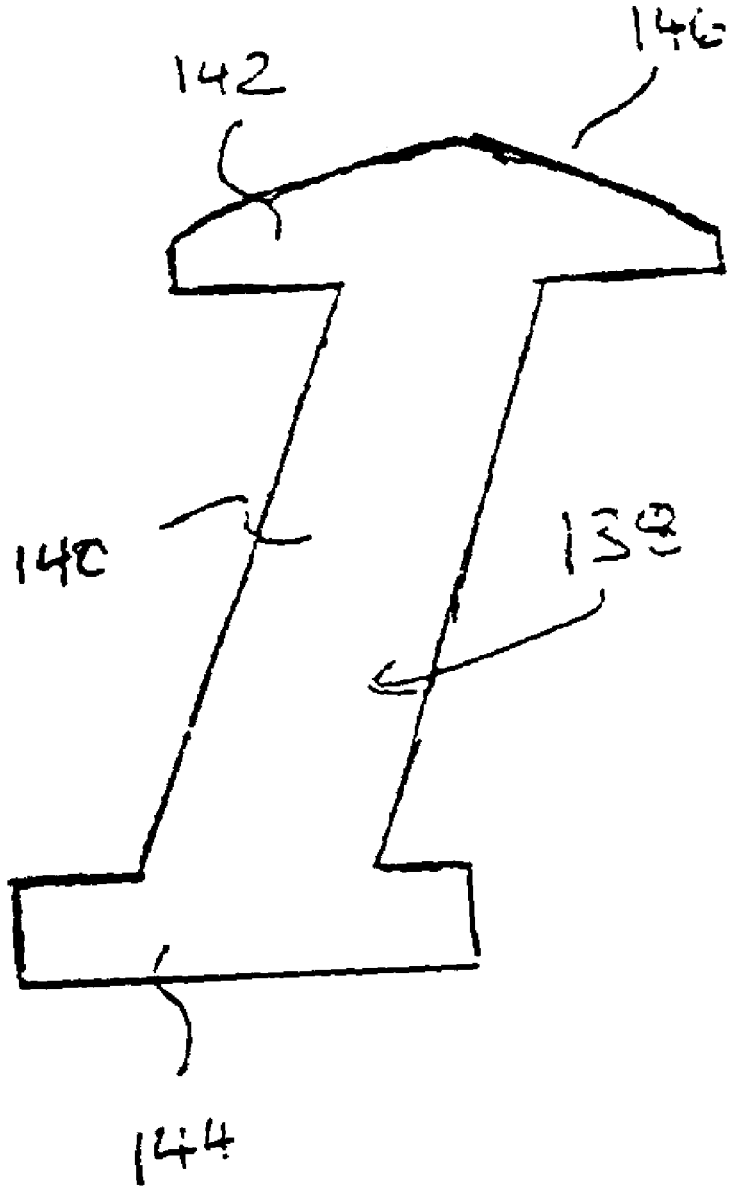
FIG. 8 illustrates an alternate construction for a connecting fastener used in securing the panel portions of the helmet construction of FIG. 7.

FIG. 8 shows best the fastener 138 used to secure the panels 26,30 to the central panel 28. The fastener 138 is formed from a semi-rigid plastic or rubber material so as to permit partial elastic deformation upon impact forces on the helmet construction 10 which do not exceed a critical load.

The fastener includes an elongated cylindrical central shaft 140, as well as an enlarged fastener head 142 and an enlarged diameter base 144. It is elongated and has a length selected to permit its insertion through the opening 74 formed in the panels 26,30 to secure the panels 26,28 and 30,28 in the identical manner as the rivet 38. Optionally, the fastener head 42 may be provided with a tapered forward surface 146 which facilitates its deformation and insertion through the aperture hole 74, enabling the fastener 138 to be positioned in a press-fit manner.

The formation of the fastener 138 from a material which permits partial elastic deformation advantageously acts to absorb impact forces. Furthermore, where an impact force does not exceed a predetermined threshold, the elastic deformation of the fastener 138 may function to provide sufficient impact absorbing forces without leading to the failure deformation of the webs 90.

Although FIGS. 3 and 8 describe the use of rivets 38 and deformable fasteners 138 as being used to secure the panels 26,28 and 30,28 together, other fastener constructions remain possible and will now become apparent.

Figure 9:
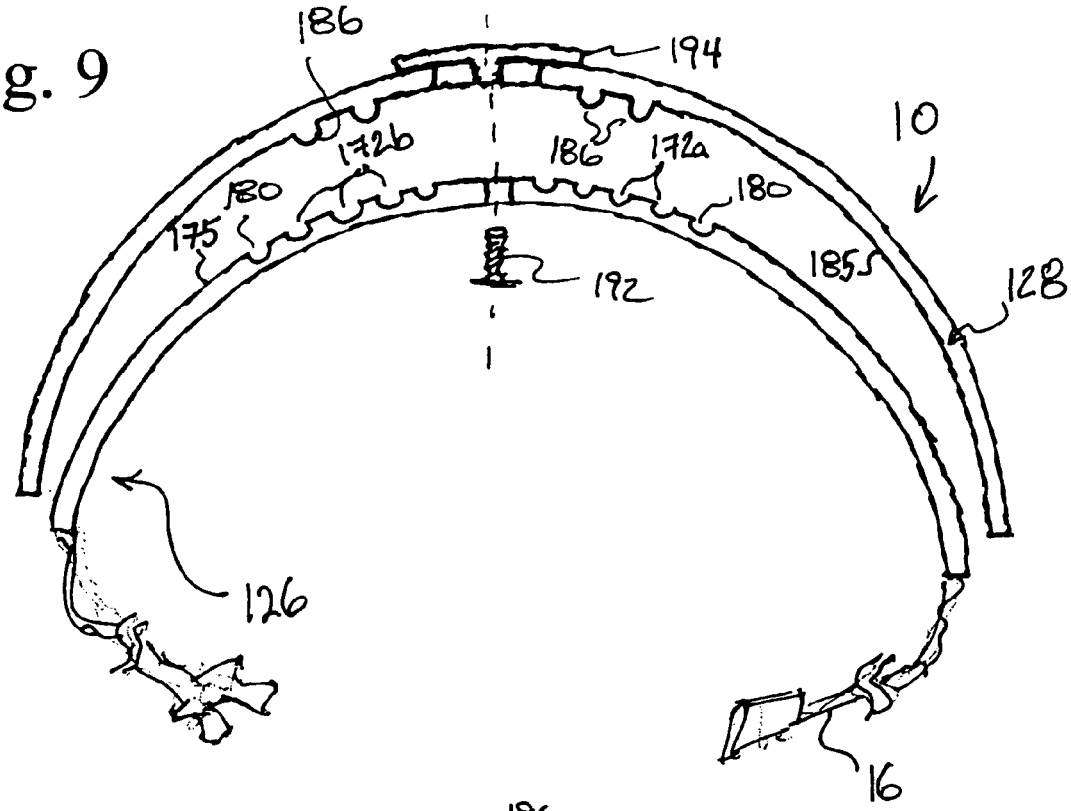
FIG. 9 shows an exploded cross-sectional view of a helmet construction in accordance with a further embodiment of the invention, illustrating the positioning of inner and outer shell panels.
Figure 10:
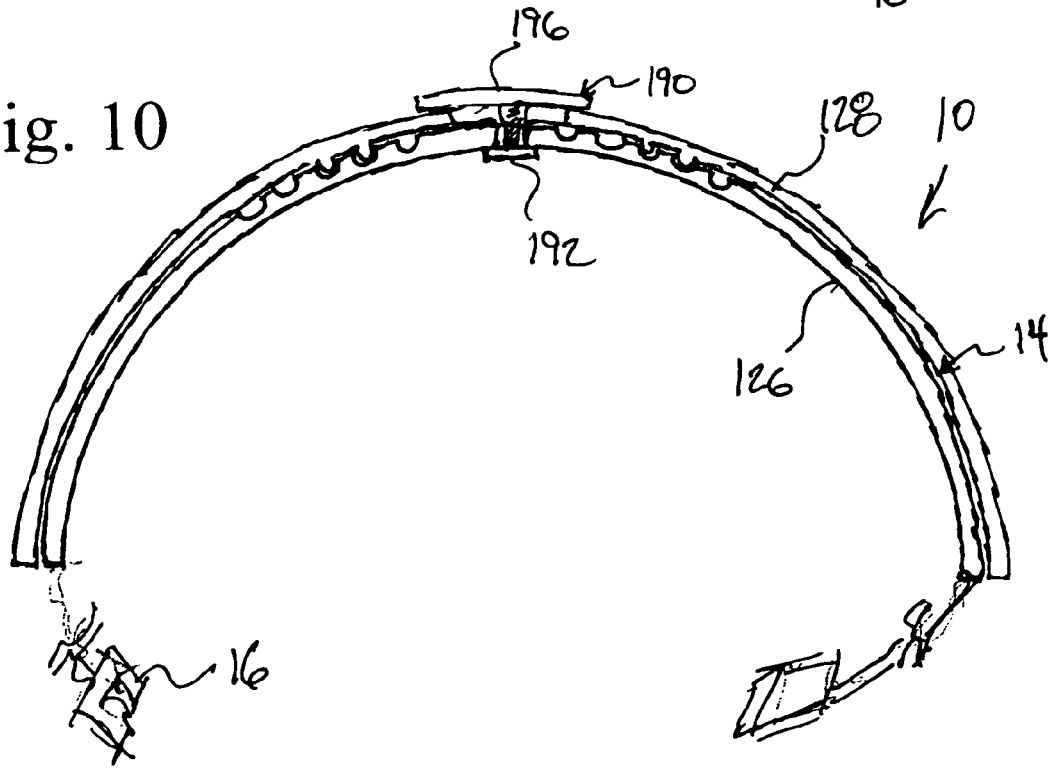
FIG. 10 shows a cross-sectional view of the helmet construction of FIG. 9 with the inner and outer panels in a first initial coupled arrangement.

Reference may be had to FIGS. 9 and 10 which show a helmet construction 10 in accordance with a further embodiment of the invention in which like reference numerals are used to identify like components. FIG. 9 shows best the helmet construction 10 as including a generally two-part dome shaped shell 14 which includes a separate and distinct inner dome-shaped panel 126 and an outer dome-shaped panel 128. As with the panels 26,28,30, the dome shaped panels 126,128 are preferably made of rigid or semi-ridged plastic and are curved to correspond to the top portion of the user's head.

Figure 12:
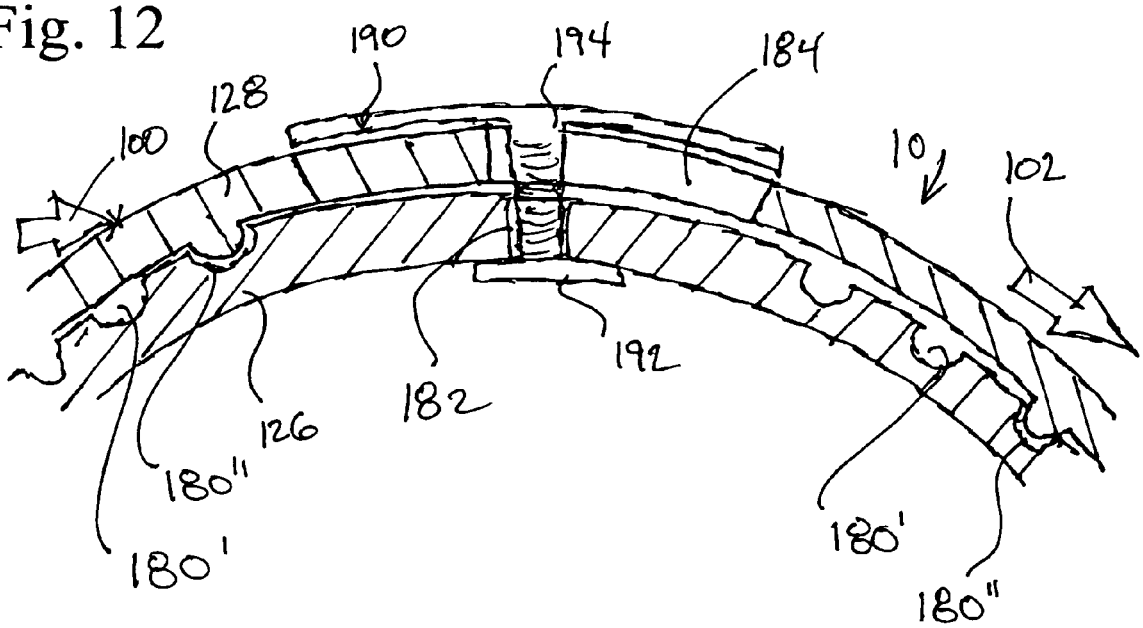
FIG. 12 shows an enlarged partial cross-sectional view of the helmet construction of FIG. 10 following impact by a predetermined threshold force, illustrating the relative displacement of the outer panel relative to the inner panel.
Figure 13:
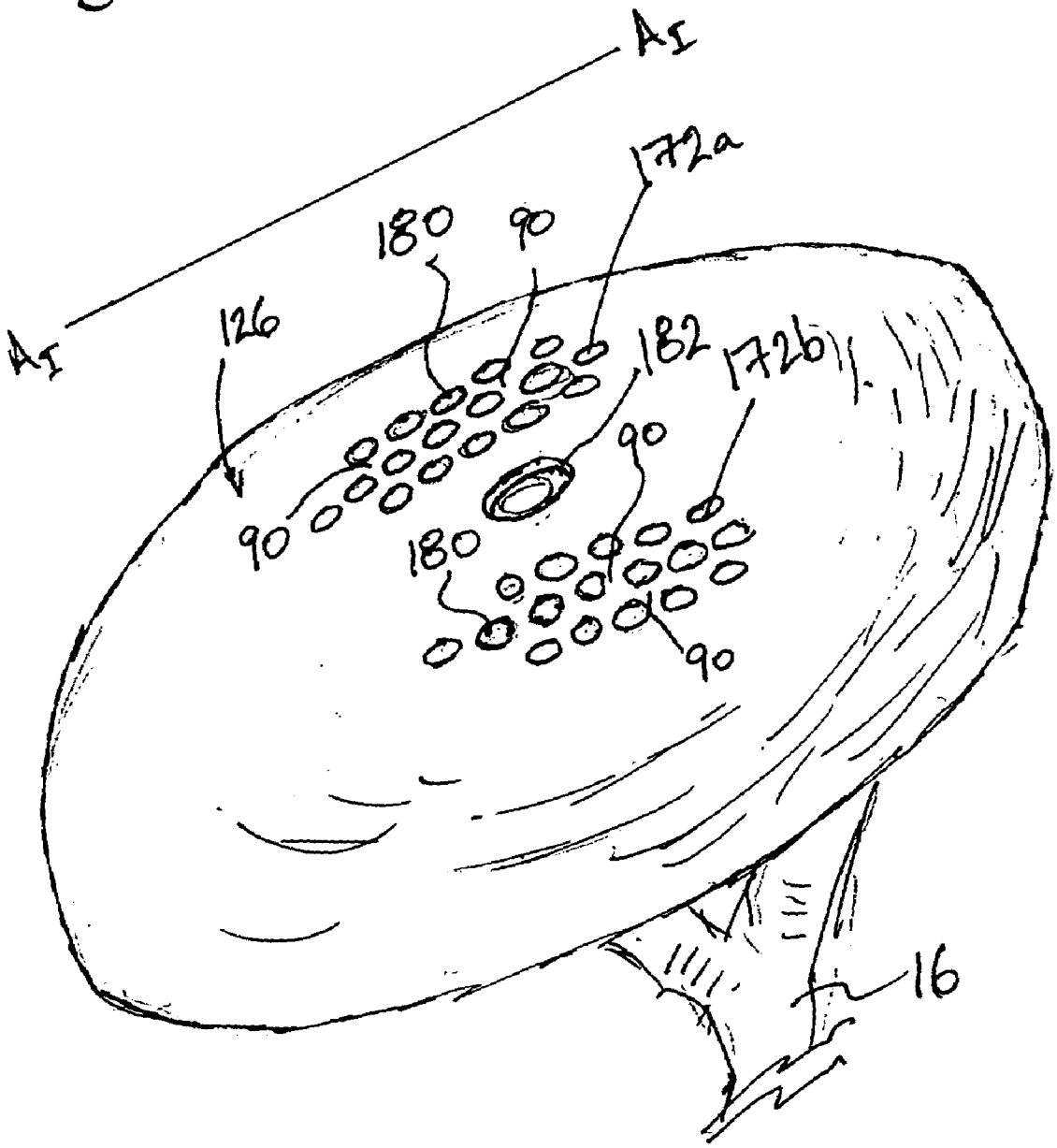
FIG. 13 shows a partial perspective view of the inner shell panel used in helmet construction of FIG. 10.

As shown best in FIGS. 9 and 13, the inner panel 126 is provided with two arrays of recesses 172*a*,172*b*. In a simplified form formed in its outward facing side surface 175 each of the arrays of recesses 172*a*,172*b* consists of a number, and preferably five or more semi-spherical depressions 180 which extend partway through the thickness of the inner panel 126. As with the openings 74,76 shown in the helmet construction 10 of FIG. 1, the depressions 180 are separated from each other by raised web 90 (FIG. 13) of plastic used in the formation of the inner panel 128. The webs 90 have a lateral width which is selected to facilitate a desired degree of sliding movement between the inner and outer panels 126,128 upon the application of a predetermined minimum impact force 100 (FIG. 12). Although not essential, the depressions 180 in each array 172*a*,172*b* may be positioned in an orientation which is generally elongated in the direction of axis $A_1–A_1$, and which corresponds to the direction of most likely impact forces for the helmet. By way of non-limiting example in a bicycle helmet the arrays of recesses 172*a*,172*b* would be elongated in a generally front to back orientation so as to absorb front-to-back impact forces. FIG. 13 furthermore shows best the inner dome panel 126 as including at a generally apically positioned a central aperture 182 extending therethrough. The aperture 182 is sized to allow the insertion of the threaded end of a screw 192 therethrough. Although not essential, most preferably, the helmet chin straps 16 are secured to the peripheral edge of the inner panel 126, along each of its sides.

Figure 11:
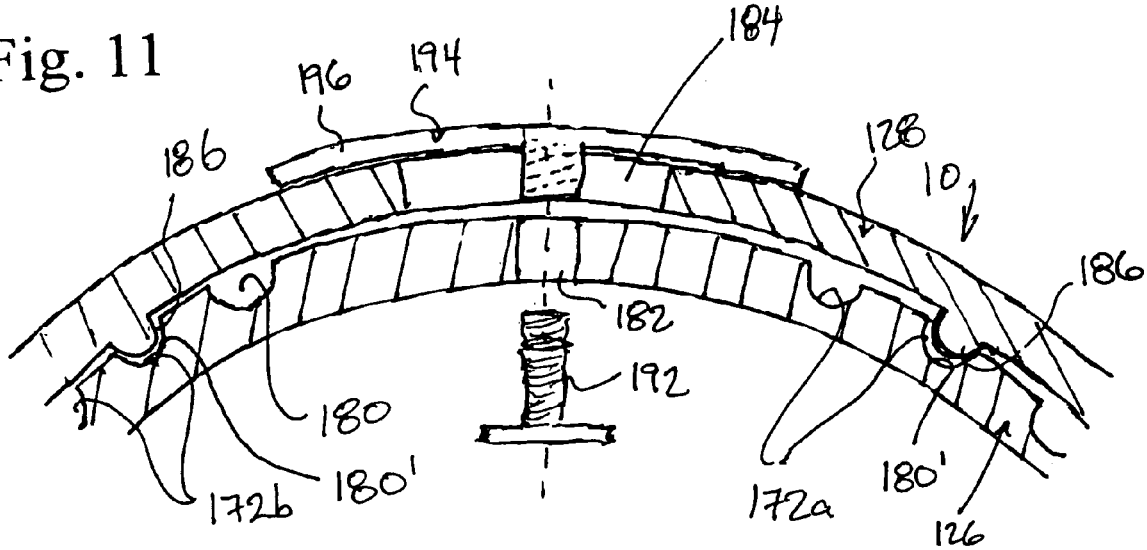
FIG. 11 shows an enlarged partially exploded view of the helmet construction of FIG. 10.

FIGS. 9 and 11 show best the outer dome shaped panel 128 as being sized to substantially overlie the inner panel 126 for attachment thereto in a substantially overlying juxtaposed position. The outer panel is provided with an enlarged apical opening 184, which is preferably provided with a diameter selected at between about 2 and 10 times the diameter of the opening 182. Most preferably, the diameter of the opening 184 is preferably selected at between about 1 and 5 cm.

FIG. 9 shows best the outer panel 128 in a most simplified construction as including a series of integrally formed bosses 186. The bosses 186 are provided along an inward facing surface 185 of the panel 128 and, as shown in best FIGS. 10 and 11, are sized and positioned so that when the outer panel 128 is secured in overlying juxtaposition with the inner panel 126, the bosses 186 locate at least partially within a respective first selected depression 180' (FIG. 11) of the adjacent array 172.

FIG. 12 shows best a fastening assembly 190 used in the physical coupling of the inner panel 126 to the outer panel 128. The fastening assembly 190 includes a flat headed screw 192 which has a head diameter selected greater than the diameter of the aperture 182, and threaded socket 194. As shown best in FIG. 11, the threaded socket 194 is adapted for threaded engagement with end of the screw 182 and furthermore includes an enlarged flange 196 which extends radially with a distance selected greater than the radial diameter of the opening 184. Although not essential, the flange 196 may be provided with a generally curved profile which substantially mirrors the curvature of the outer dome panel 128. Other socket configurations are however envisioned.

In the coupling of the inner and outer panels 126,128, the outer panel 128 is positioned in overlying juxtaposition with the inner panel 126, so that with each boss 186 at least partially disposed in the selected corresponding depressions 180', thereby functioning as a locating member ensuring the proper initial positioning of the panels 126,128. The socket 194 is positioned in the aperture 184 and over the opening 182. The screw 192 is then inserted through the opening 182 and into threaded engagement with the socket 194. It is to be appreciated that depending upon the degree of tightening the screw of 192 in the socket 194, it is possible to adjust the relative compressive tension between the inner panel 126 and outer panel 128 to thereby permit adjustment in the amount of predetermined force necessary to effect movement of the outer panel 128, relative to the inner panel. For example, in this manner, by providing a lessened tension on the screw 192, it is possible to provide for more readily sliding movement between the outer panel 128 and inner panel 126.

As shown in FIG. 12, upon the application of a predetermined minimum impact force (Arrow 100) on the outer panel 128, the impact force results in the sliding movement of the outer panel 128 relative to the inner panel 126. In particular, the impact force results in the outer panel 128 movement (in direction of Arrow 102) to displace the bosses 186 from the initial position partially engaging the selected recess 180 in the direction of impact forces, and into a next adjacent recess 180". It is to be appreciated that the movement of the bosses 186 into and from successive recesses 180 acts to absorb and dissipate the impact forces, lessening the transmission of the force to the inner panel 126 and ultimately the user's head.

The present helmet construction 10, thus, advantageously permits adjustment in the amount of force which may be required to effect movement of the inner and outer panels 126,128 relative to each other by increasing or decreasing the compressive force through the adjustment of the screw member 192.

Figure 14:
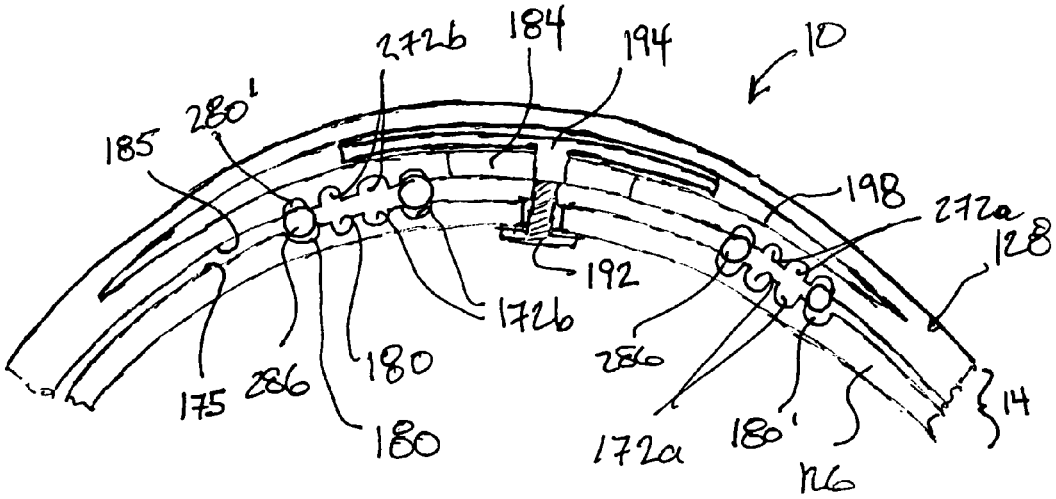
FIG. 14 shows a partial cross-sectional view of a helmet construction showing the manner of the interconnecting inner and outer panels in accordance with a further embodiment of the invention.
Figure 15:
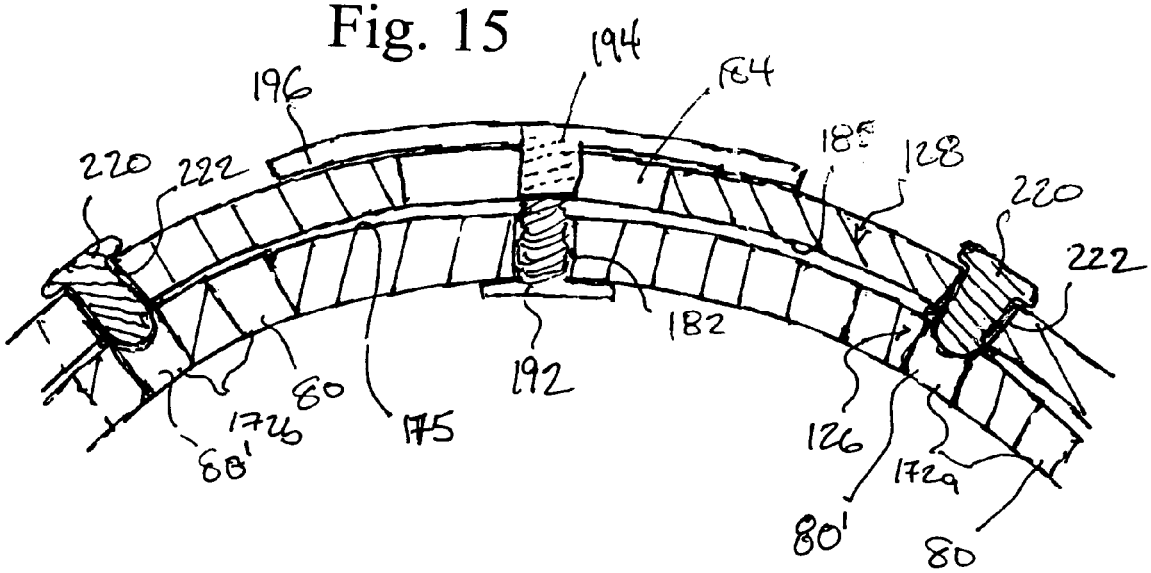
FIG. 15 shows a partial cross-sectional view of a helmet construction showing the manner of the interconnecting inner and outer panels in accordance with a further embodiment of the invention.

Although FIGS. 11 and 12 show bosses 186 as the locating member used to initially position the inner and outer panels 126,128 and absorb impact forces, the invention is not so limited. Reference may be had to FIGS. 14 and 15 which show locating members of alternate possible constructions and where like reference numerals are used to identify like components.

In the embodiment of FIG. 14, the outer shell 128 is provided with a dual wall construction which defines a centrally disposed recess 198 in which the socket 194 is positioned. The outer panel 128 further includes along its inward facing surface 185 further arrays 272*a*, 272*b* of semi-spherical depressions 280 which are positioned overlying juxtaposition with the arrays 172*a*,172*b* of depressions formed in the inner shell panel 126 when the outer and inner panels 128,126 are secured to each other.

A series of resilient or semi-resilient Nylon™, metal or other plastic bearings 286 are provided so as to partially engage a selected pair of juxtaposition depressions 180',280' formed in both the inner and outer panels 126,128. It is to be appreciated that the bearings 286 act in essentially the same function as the bosses 186 shown in FIG. 10. Upon the application of a predetermined minimum as the outer panel 128 and inner panel 126 more relative to each other, the bearings 286 relocate from the force, moving from initial selected positions disposed partially in each of adjacent initially selected recesses 180',208' to engage a next adjacent recesses 180,280, absorbing impact forces.

In FIG. 15, the recesses formed in the inner shell 126 are provided as through apertures 80 which form each array 172*a*,172*b*. A series of Nylon™ or other semi-rigid plugs 220 are insertable through aligned apertures 222 formed through the outer panel 128. The plugs 220 have a length selected so as to partially engage a selected aperture 80' in initial attachment of the inner and outer panels 126,128 to each other. As with the embodiments shown in FIGS. 11 and 14, upon the application of a predetermined minimum impact force, the relative movement of the inner and outer panels 126,128, results in the repositioning of the plug 220 from its initial position so as to locate at least partially in a next adjacent aperture 80.

Although the preferred embodiment describes the helmet construction 10 as a bicycle helmet, the invention is not so limited. It is to be appreciated that the helmet construction 10 of the present invention could be modified for almost any sports or non-sports application where a protective head covering could be required. Applications for the helmet construction 10 include, without restriction, its use as a horseback riding helmet, as a hard hat or construction helmet, football helmet, skateboard or snowboard helmet, a motorcycle or race car driver helmet, or an army helmet for use in military applications and the like.

While the preferred embodiment describes and illustrates a rivet 38 used in the interconnection of the side panels 26,30 to the central panel 26, the invention is not so limited. If desired, other types of connectors including pins, screws and/or slot and tab connectors could also be used.

Although the detailed description describes and illustrates various preferred embodiments, the invention is not so limited. Many modifications will now occur to persons skilled in the art. For a definition of the invention, reference may be had to the appended claims.

I claim:

1. A helmet for protecting a user's head from impact forces, said helmet comprising, a generally dome shaped shell, said shell being formed from a rigid or semi-rigid material and sized and contoured to cover a surface of said user's head to be protected, said shell including a first portion and a second portion, a plurality of locating recesses formed in a region of said first portion, the recesses being delineated from a next immediately adjacent recess by a web member, said second portion including at least one locating boss positioned to align with a selected one of said recesses when part of said second portion is located substantially in overlying juxtaposition with said first portion, and a fastener coupling the first portion in overlying juxtaposition with the second portion, under a tension selected so that the application of a predetermined minimum force to at least one of said first portion and said second portion enables relative movement of the at least one boss from the selected one of said recesses into a next adjacent recess and the limited movement of said first portion relative to said second portion.

2. The helmet of claim 1 wherein said locating recesses comprise apertures formed through said first portion.

3. The helmet as claimed in claim 1 wherein said plurality of recesses comprise an array of at least 10 recesses.

4. The helmet as claimed in claim 1 wherein said boss is integrally formed with said second portion.

5. The helmet of claim 3 wherein the first portion is characterized by a double wall construction comprising a pair of spaced apart shell walls defining an interior area therebetween, at least part of the second portion being at least partially disposed in said interior area.

6. The helmet of claim 5 wherein said first portion comprises a central portion of said helmet, said central portion being elongated in a longitudinal direction.

7. The helmet as claimed in claim 3 wherein each of said recesses comprises a generally semi-spherical depression formed in said first portion, each said recess being separated from the next adjacent recess by a distance selected less than 1 cm.

8. The helmet of claim 1 wherein said fastener comprises a threaded fastener and wherein said tension is adjustable by the relative tightening or loosening of said fastener.

9. The helmet of claim 1 further including impact absorbing cushioning secured to an inner surface of said shell, said cushioning being resiliently compressible so as to compress with any movement of said first portion relative to said second portion.

10. The helmet of claim 1 wherein said helmet is selected from the group consisting of a hard hat, a military helmet, a sports helmet, and a bike helmet.

11. A protective head covering for protecting a user's head comprising a generally rigid shell, the shell including a central portion contoured so as to substantially cover the upper front and rear portions of said user's head, and having an outer panel and an inner panel, a first array of recesses in a first one of said inner panel and said outer panel, at least one locating member for engagement with a selected one of said recesses of said first array, said locating member engaging the second other one of said inner panel, a coupling member coupling the inner panel to the outer panel under a tension selected whereby the application of a predetermined minimum force to the covering results in the limited movement of the inner panel relative to said outer panel, and the movement of the locating member in the direction of impact forces from the selected recess into engagement with at least one next adjacent recess.

12. The head covering as claimed in claim 11 wherein said locating member comprises a boss, said boss being integrally formed with said outer panel.

13. The head covering as claimed in claim 11 wherein said recesses comprise generally semi-spherical depressions formed in said inner panel.

14. The head covering as claimed in claim 11 wherein said recesses comprise through openings formed through said inner panel.

15. The head covering of claim 11 wherein said shell has a radial diameter which is selected not greater than about four inches larger than a radial diameter of said user's head.

16. The helmet of claim 15 wherein said coupling member comprises a threaded fastener and threaded socket wherein said tension is adjustable by the relative tightening or loosening of said threaded fastener in said socket.

17. A helmet for protecting a user's head from frontal and side impacts, said helmet comprising, a generally dome shaped shell, said shell sized and contoured to substantially cover said user's head, and including an outer, central member elongated longitudinally so as to extend across front and rear portions of said user's head and an inner central member sized for overlying a portion of said user's head and provided in overlying juxtaposition with a part of said outer central member, at least one of the outer central member and the inner central member including a first array of a plurality recesses formed therein, the other one of said outer central member and the inner central member including a locating boss positioned so as to align with a selected one of said plurality of recesses in said first array, and at least one fastener connecting the inner central member to the outer central member under a tension selected, whereby the application of a predetermined minimum force to at least one of the outer central member and the inner central member enables both relative sliding movement of the boss into a next adjacent recess and the limited relative movement of the outer and inner central members.

18. The helmet as claimed in claim 17 wherein the plurality of recesses of each of said first array are delineated from the next immediately adjacent recess by a web member.

19. The helmet of claim 17 wherein said outer central member is characterized by a double wall construction comprising a pair of spaced apart walls defining an interior area therebetween, said inner central member being at least partially disposed in the interior area.

20. The helmet of claim 17 wherein said shell has a radial diameter which is selected not greater than about four inches larger than the radial diameter of said user's head, and said helmet comprises a hard hat.

* * * * *